US005192460A

United States Patent [19]

Thomas et al.

[11] Patent Number: 5,192,460

[45] Date of Patent: * Mar. 9, 1993

[54] SAFE ACIDIC HARD SURFACE CLEANER

[75] Inventors: Michel Thomas, Couthuin; Genevieve Blandiaux, Trooz; Baudouin Valange, Gembloux, all of Belgium

[73] Assignee: Colgate-Palmolive Company, New York, N.Y.

[ * ] Notice: The portion of the term of this patent subsequent to Aug. 13, 2008 has been disclaimed.

[21] Appl. No.: 388,731

[22] Filed: Jul. 31, 1989

Related U.S. Application Data

[63] Continuation-in-part of Ser. No. 154,837, Feb. 10, 1988, abandoned.

[51] Int. Cl.[5] ..... C11D 1/12; C11D 1/34; C11D 1/66; C11D 1/83

[52] U.S. Cl. ..... 252/142; 252/136; 252/174.19; 252/526; 252/542; 252/174.17; 134/3

[58] Field of Search ..... 252/136, 142, 174.19, 252/526, 545, 174.17; 134/3

[56] References Cited

U.S. PATENT DOCUMENTS

| | | | |
|---|---|---|---|
| 3,218,260 | 11/1965 | Lewandowski | 252/142 |
| 3,586,633 | 6/1971 | Schlussler | 252/136 |
| 4,435,223 | 3/1984 | Dollman | 252/136 |
| 4,501,680 | 2/1985 | Aszman | 252/142 |
| 4,581,161 | 4/1986 | Nedonchelle | 252/550 |
| 4,666,615 | 5/1987 | Disch et al. | 252/173 |
| 4,878,951 | 11/1989 | Pochard et al. | 134/34 |

FOREIGN PATENT DOCUMENTS

| | | |
|---|---|---|
| 0027083 | 4/1981 | European Pat. Off. . |
| 0040038 | 11/1981 | European Pat. Off. . |
| 0336878 | 10/1989 | European Pat. Off. . |
| 2106927 | 4/1983 | United Kingdom . |

OTHER PUBLICATIONS

McCutcheon's Detergents and Emulsifiers, North American Edition 1978, p. 207.

*Primary Examiner*—Jacqueline Howard
*Assistant Examiner*—J. Silbermann
*Attorney, Agent, or Firm*—Bernard Lieberman; Robert C. Sullivan

[57] ABSTRACT

An acidic aqueous cleaner, preferably in emulsion or microemulsion form, which is of a pH in the range of one to four and is useful for cleaning hard surfaced items, such as bathtubs, sinks, tiles and porcelains, and even some such items which are not acid resistant, such as those of a European enamel known as zirconium white enamel, comprises synthetic organic detergent, such as a mixture of anionic and nonionic detergents, e.g., sodium paraffin sulfonate, higher fatty alcohol ethoxylate sulfate and higher fatty alcohol or phenol ethoxylate, organic acid, e.g., mixture of succinic, glutaric and adipic acids, phosphonic acid, e.g., aminotris-(methylenephosphonic acid) and phosphoric acid in an aqueous medium.

The acidic cleaner is useful to remove soap scum, lime scale and grease from surfaces of the mentioned items without adversely affecting such surfaces, and removals of the scum, scale and grease are easy, being effected by applying the microemulsion to the surface to be cleaned, followed by wiping it off. Although the cleaned surfaces may be rinsed that is often not necessary and the surfaces will be left clean and shiny after wiping, even without rinsing, or with minimal rinsing.

In the described emulsions the organic acid components effectively remove soap scum and lime scale, the detergents remove greasy soils and promote effective contact between the acid and the surfaces to be treated, and the combination of phosphoric and phosphonic acids prevents acidic attack by the organic acid(s) on the European enamel surface being cleaned.

20 Claims, No Drawings

SAFE ACIDIC HARD SURFACE CLEANER

This application is a continuation-in-part of our application Ser. No. 07/154,837, which was filed on Feb. 10, 1988, and is now abandoned.

This invention relates to a cleaner for hard surfaces, such as bathtubs, sinks, tiles, porcelain and enamelware, which removes soap scum, lime scale and grease from such surfaces without harming them. More particularly, the invention relates to an acidic microemulsion that can be sprayed onto the surface to be cleaned, and wiped off without usual rinsing, and still will leave the cleaned surface bright and shiny. The invention also relates to a method for using such compositions.

Hard surface cleaners, such as bathroom cleaners and scouring cleansers, have been known for many years. Scouring cleansers normally include a soap or synthetic organic detergent or other surface active agent, and an abrasive. Such products can scratch relatively soft surfaces and can eventually cause them to appear dull. Also, they are sometimes ineffective to remove lime scale (usually encrusted calcium and magnesium carbonate) in normal use. Because lime scale can be removed by chemical reactions with acidic media many acidic cleaners have been produced, which have met with various degrees of acceptance. In some instances such cleaners have been failures because the acid employed was too strong and damaged the surfaces being cleaned. At other times, the acidic component of the cleaner reacted objectionably with other components of the product, adversely affecting the detergent or perfume, for example. Some cleaners required rinsing afterward to avoid leaving objectionable deposits on the cleaned surfaces.

As a result of research performed in efforts to overcome the mentioned disadvantages there have recently been manufactured improved liquid cleaning compositions in stable microemulsion form which are effective to remove soap scum, lime scale and greasy soils from hard surfaces, such as bathroom surfaces, and which do not require rinsing after use. Such products are described in pending U.S. patent application Ser. No. 07/120,250, now U.S. Pat. No. 5,076,954 for STABLE MICROEMULSION CLEANING COMPOSITION, filed Nov. 12, 1987, by Loth, Blanvalet and Valange, which application is hereby incorporated by reference. In particular, Example 3 of that application discloses an acidic, clear, oil-in-water microemulsion which is therein described as being successfully employed to clean shower wall tiles of lime scale and soap scum that had adhered to them. Such cleaning was effected by applying the cleaner to the walls, followed by wiping or minimal rinsing, after which the walls were allowed to dry to a good shine.

The described microemulsion cleaner of the patent application is effective in removing lime scale and soap scum from hard surfaces, and is easy to use, but it has been found that its mixture of acidic agents (succinic, glutaric and adipic acids) could damage the surfaces of some hard fixtures, such as those of materials which are not acid resistant. One of such materials is an enamel that has been extensively employed in Europe as a coating for bathtubs, herein referred to as European enamel, zirconium white enamel or zirconium white powder enamel, which has the advantage of being resistant to detergents, which makes it suitable for use on tubs, sinks, shower tiles and bathroom enamelware. However, such enamel is sensitive to acids and is severely damaged by use of the microemulsion acidic cleaner based on the three organic carboxylic acids, which was mentioned previously. That problem has been solved by the present invention, in which additional acidic materials are incorporated in the cleaner with the organic acids, and rather than exacerbating the problem, they prevent harm to such European enamel surfaces by such organic acids. Also, the mixture of such additional acids, aminoalkylenephosphonic and phosphoric acids, surprisingly improves the safety of the aqueous cleaner for use on such European enamel surfaces and decreases the cost of the cleaner, when such cost is compared to that of a cleaner containing an effective proportion of the aminoalkylenephosphonic acid only. Thus, the present invention allows the cleaning by the invented emulsion of European enamel surfaces, as well as any other acid resistant surfaces of bathtubs, and other bathroom surfaces. However, the product should not be used on materials that are especially susceptible to attack by acidic media, such as marble.

In accordance with the present invention an acidic aqueous liquid cleaner for bathtubs and other hard surfaced items which are acid resistant or are of zirconium white enamel, which cleaner is of a pH in the range of 1 to 4, and which removes lime scale, soap scum and greasy soil from surfaces of such items without damaging such surfaces, comprises: a detersive proportion of synthetic organic detergent, which is capable of removing greasy soil from such surfaces; a lime scale and soap scum removing proportion of organic acid(s) having 2 to 10 carbon atoms therein, which group of acids excludes oxalic and malonic acids, an aminoalkylenephosphonic acid, and phosphoric acid, with the proportions of such aminoalkylenephosphonic and phosphoric acids being such as to prevent damage to zirconium white enamel surfaces of items to be cleaned by the organic acid(s) when the cleaner is employed to clean such items; and an aqueous medium for the detergent, organic acid(s), aminoalkylenephosphonic acid and phosphoric acid.

In the present compositions the synthetic organic detergent may be any suitable anionic, nonionic, amphoteric, ampholytic, zwitterionic or cationic detergent or mixture thereof, but the anionic and nonionic detergents are preferred, as are mixtures thereof. Of the anionics the more preferred are water soluble salts of lipophilic sulfonic and sulfuric acids, the lipophilic moieties of which include long chain aliphatic groups, preferably long chain alkyls, of 8 to 20 carbon atoms, more preferably of 12 to 18 carbon atoms. Although several different types of solubilizing cations may be present in the anionic detergents it will usually be preferred that they be alkali metal, e.g., sodium or potassium or a mixture thereof, ammonium, or lower alkanolamine, of 2 to 3 carbon atoms per alkanol moiety. It is a desirable feature of the present invention that sodium may be the alkali metal employed, and the emulsions resulting will be stable and effective.

Much preferred salts of lipophilic sulfonic acids are paraffin sulfonates, wherein the paraffin group is of 12 to 18 carbon atoms, preferably 14 to 17 carbon atoms. Other useful sulfonates are olefin sulfonates wherein the olefin starting material is of 12 to 18 carbon atoms, e.g., 12 to 15, and linear alkylbenzene sulfonates wherein the alkyl is of 12 to 18 carbon atoms, preferably 12 to 16 carbon atoms, e.g., 12 or 13. All such sulfonates will preferably be employed as their sodium salts, but other salts are also operative.

Much preferred salts of lipophilic sulfuric acids are of higher alkyl ethoxylate sulfuric acids, which may also be designated as higher alkyl ethyl ether sulfuric acids. However, higher alkyl sulfates and various other well-known detergent sulfates, may be employed instead, at least in part. The higher alkyls of such compounds are of the chain lengths mentioned above for this class of anionic detergents, -8 to 20 carbon atoms, and preferably are of 10 to 14 carbon atoms, e.g., 12 or about 12 carbon atoms. Such compounds should include from 1 to 10 ethylene oxide groups per mole, preferably 1 to 7 ethylene oxide groups per mole, e.g., 2. A preferred cation is sodium but other cations mentioned above for their solubilizing functions may be employed in suitable circumstances.

The nonionic detergents that are useful in this invention may be any of the nonionic detergents known to the art (as may be other types of detergents that satisfy the conditions set in this specification). Many such detergents are described in the text *Surface Active Agents (Their Chemistry and Technology)* by Schwartz and Perry, and in the various annual editions of John W. McCutcheon's *Detergents and Emulsifiers.* However, the nonionics will usually be condensation products of a lipophilic moiety, such as a higher alcohol or phenol, or a propylene glycol or propylene oxide polymer, with ethylene oxide or ethylene glycol. In some of the condensation products of ethylene oxide and higher fatty alcohol or alkyl substituted phenol (in which the alkyl on the phenol nucleus is usually of 7 to 12 carbon atoms, preferably 9), some propylene oxide may be blended with the ethylene oxide so that the lower alkylene oxide moiety in the nonionic detergent is mixed, whereby the hydrophilic-lipophilic balance (HLB) may be controlled.

Most preferred nonionic detergents present in the invented emulsions will be condensation products of a fatty alcohol of 8 to 20 carbon atoms with from 3 to 20 moles of ethylene oxide, preferably of a linear alcohol of 9 to 15 carbon atoms, such as 9–11 or 11–13 carbon atoms, or averaging about 10 or 12 carbon atoms, with 3 to 15 moles of ethylene oxide, such as 3–7 or 5–9 moles of ethylene oxide, e.g., about 5 or 7 moles thereof. In place of the higher fatty alcohol one may use an alkylphenol, such as one of 8 to 10 carbon atoms in a linear alkyl, e.g., nonylphenol, and the phenol may be condensed with from 3 to 20 ethylene oxide groups, preferably 8 to 15. Similarly functioning nonionic detergents that are polymers of mixed ethylene oxide and propylene oxide may be substituted, at least in part, for the other nonionics. Among such are those sold under the trademarks Synperonic and Plurafac, such as Synperonic RA-30 and Plurafac LF-400, which are available from ICI and BASF, respectively. Preferred such nonionics contain 3 to 12 ethoxies, more preferably about 7, and 2 to 7 propoxy groups, more preferably about 4, and such are condensed with a higher fatty alcohol of 12–16, more preferably 13–15 carbon atoms, to make a mole of nonionic detergent.

The various nonionic detergents and anionic detergents are often in mixtures, which are intended to be within the singular designations herein employed, for convenience.

The active acidic component of the emulsions is an organic acid which is strong enough to lower the pH of the emulsion so that it is in the range of 1–4, preferably about 3. Carboxylic and other acids, such as ascorbic acid, can perform this function but most of those which have been found to be usefully effective and which appear to remove soap scum and lime scale from bathroom fixture surfaces, while still not destabilizing the emulsion, are of 2 to 10 carbon atoms. Preferably such acids are of 3 to 8, 3 to 6 or 4 to 6 carbon atoms, and are carboxylic. They may be mono-, di- or poly-carboxylic, of which the dicarboxylic acids are preferred. In the dicarboxylic acids group suberic, azelaic, sorbic and sebacic acids are of lower solubilities than the desired 1% or more, in water, and therefore they are not as useful in the present microemulsions as the other dibasic aliphatic fatty acids, which are preferably saturated and straight chained. Oxalic and malonic acids, although effective as pH reducing agents, are considered to be too strong for cleaning European enamel surfaces, and oxalic acid is too toxic for incorporation in the present cleaners. Valeric acid tends to cause microemulsion phase separations and therefore is often avoided. Preferred dibasic acids are those of the middle portion of the 2 to 10 carbon atoms range, such as 4 to 8, and more preferably 4 to 6 carbon atoms, including succinic, glutaric, adipic and pimelic acids, especially the first three thereof, which fortunately are available commercially, and in mixtures. Such mixtures will be of proportions in the ranges of 0.8–4:0.8–10:1, or 1–3:1–6:1, e.g., 1:1:1 and 2:5:1, respectively. These and other operative organic acids, before or after being incorporated in the invented emulsions, may be partially neutralized to produce the desired pH of the microemulsion for greatest functional effectiveness, with safety.

Monobasic, tribasic and other polybasic acids of the same carbon atoms contents may also be employed instead of dibasic acids (both saturated and unsaturated), as may be hydroxycarboxylic acids. Such are often saturated straight chain acids but may be alkylenically unsaturated (often with a single double bond). Normally they will be aliphatic, rather than aromatic, but they may be cycloaliphatic. Such acids, which are useful in the invented compositions instead of the saturated dicarboxylic acids, may be described as monocarboxylic acids, unsaturated dicarboxylic acids, saturated tri- or higher carboxylic acids, unsaturated monocarboxylic acids, unsaturated tri- or higher carboxylic acids, alicyclic unsaturated dihydroxy acids, and polylower alkoxylated higher aliphatic acids. Any mixtures of such acids may also be employed. Representative of the various operative organic acids, in addition to the aforementioned specific dicarboxylic acids, are acetic acid, propionic acid, citric acid, malic acid, tartaric acid, acrylic acid, maleic acid, lactic acid, gluconic acid, ascorbic acid and "nonionic acid", such as $RO(C_2H_4O)_{3\text{-}7}CH_2COOH$, wherein R is alkyl of 10 to 14 carbon atoms, e.g., $C_{12}H_{25}O(C_2H_4O)_5CH_2COOH$, which is obtainable from Chemy as Akypo TM RLM 45 Such acids may be employed singly or in any mixture with each other and with the previously described dibasic acids.

Phosphoric acid is one of the additional acids that, in combination, protects acid-sensitive surfaces of European enamel being cleaned with the present microemulsion cleaner. Being a tribasic acid, it may be partially neutralized to produce an emulsion pH in the desired range, about 3. For example, it may be partially neutralized to monosodium phosphate, $NaH_2PO_4$, or monoammonium phosphate, $NH_4H_2PO_4$.

The aminophosphonic acids are the other of the two acids of the combination that protects acid-sensitive European enamel surfaces from the dissolving or etching actions of the mentioned organic acids of the present emulsions. Phosphonic acid apparently exists only theoretically, but its amino derivatives are stable and are useful in the practice of the present invention. Such are considered to be phosphonic acids, as that term is used in this specification. The phosphonic acids are of the structure

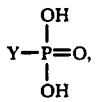

wherein Y is any suitable substituent, but preferably Y is alkylamino or N-substituted alkylamino. For example, a preferred phosphonic acid component of the present emulsions is aminotris-(methylenephosphonic) acid, which is of the formula $N(CH_2PH_2O_3)_3$. Among other useful phosphonic acids are ethylenediamine tetra-(methylenephosphonic) acid, hexamethylenediamine tetra-(methylenephosphonic) acid, and diethylenetriamine penta-(methylenephosphonic) acid. Such class of compounds may be described as aminoalkylenephosphonic acids containing in the ranges of 1 to 3 amino nitrogens, 3 to 5 lower alkylenephosphonic acid groups in which the lower alkylene is of 1 or 2 carbon atoms, and 0 to 2 alkylene groups of 2 to 6 carbon atoms each, which alkylene(s) is/are present and 3oin amino nitrogens when a plurality of such amino nitrogens is present in the aminoalkylenephosphonic acid. It has been found that such aminoalkylene phosphonic acids, which also may be partially neutralized at the desired pH of the microemulsion cleaner, are of desired stabilizing and protecting effect in the invented cleaner. especially when present with phosphoric acid, preventing harmful attacks on European enamel surfaces by the "organic acid" component(s) of the cleaner. Usually the phosphorus acid salts, if present, will be mono-salts of each of the phosphoric and/or phosphonic acid groups present.

The water that is used in making the present microemulsions may be tap water but is preferably of low hardness, normally being less than 150 parts per million (p.p.m.) of hardness, as calcium carbonate. Still, useful cleaners can be made from tap waters that are higher in hardness, up to 300 p.p.m., as $CaCO_3$. Most preferably the water employed will be distilled or deionized water, in which the content of hardness ions is less than 25 p.p.m., usually being nil. Employment of such deionized water allows for the manufacture of a product of consistently good qualities, independent of hardness variations in the aqueous medium.

Various other components may desirably be present in the invented cleaners, including preservatives, antioxidants or corrosion inhibitors, cosolvents, cosurfactants, multivalent metals or metal ions, perfumes, colorants and terpenes (and terpineols), but various other adjuvants conventionally employed in liquid detergents and hard surface cleaners may also be present, provided that they do not interfere with the cleaning and scum- and scale-removal functions of the cleaner. Of the various adjuvants (which are so identified because they are not necessary for the production of an operative cleaner, although they may be very desirable components of the cleaner) the most important are considered to be the perfumes, which, with terpenes, terpineols and hydrocarbons (which may be substituted for the perfumes or added to them) function as especially effective solvents for greasy soils on hard surfaces being cleaned, and form the dispersed phases of oil-in-water (o/w) microemulsions. Also of functional importance are the cosurfactant and polyvalent metal ions, with the former helping to stabilize the microemulsion and the latter aiding in improving detergency, especially for more dilute cleaners, and when the polyvalent salts of the anionic detergent employed are more effective detergents against the greasy soil encountered in use.

The various perfumes that have been found to be useful in forming the dispersed phase of the o/w microemulsion cleaners include those normally employed in cleaning products, and preferably are normally in liquid state. They include esters, ethers, aldehydes, alcohols and alkanes employed in perfumery but of most importance are the essential oils that are high in terpene content. It appears that the terpenes (and terpineols) coact with the detersive components of microemulsions to improve detergency of the invented composition, in addition to forming the stable dispersed phase of the microemulsions. In the present invention it has been found that especially when a piney perfume is being employed, one can decrease the proportion of comparatively expensive such perfume and can compensate for it with alpha-terpineol, and in some instances with other terpenes. For example, for every 1% of perfume one can substitute from 60 to 90% of it, e.g., about 80%, with alpha-terpineol, and obtain essentially the same piney scent, with good cleaning and microemulsion stability. Similarly, terpenes and other terpene-like compounds and derivatives may be employed, but alpha-terpineol is considered to be the best.

The mentioned perfumes, terpenes and terpene-like compounds help to form the desired microemulsions and help to clean effectively, but especially for passive or static cleaning operations it may also be desirable to include in the microemulsion formula, as an adjuvant-,solvents, such as $C_5$–$C_{10}$ hydrocarbons, e.g., n-octane, isoparaffins and pine oil.

The polyvalent metal or metal ion, which is optionally present in the invented cleaners, may be any suitable such metal or ion, including magnesium (usually preferred), aluminum, copper, nickel, iron or calcium, and the metal or ion or mixture thereof may be added in any suitable form, sometimes as an oxide or hydroxide, but usually as a water soluble salt. It appears that the polyvalent metal ion reacts with the anion of the anionic detergent (or replaces the detergent cation, or makes an equivalent solution in the emulsion), which improves detergency and generally improves other properties of the product, too. If the polyvalent metal ion reacts with the detergent anion to form an insoluble product such polyvalent ion should be avoided. For example, calcium reacts with paraffin sulfonate anion to form an insoluble salt, so calcium ions, such as might be obtained from calcium chloride, will be omitted from any emulsion cleaners of this invention that contain paraffin sulfonate detergent. Similarly, those polyvalent metals, or ions or other components of the invented compositions that will react adversely with other components will also be omitted. As was mentioned previously, the polyvalent metal or ion will preferably be magnesium, and such is preferably admixed with other emulsion components as a water soluble salt. A preferred such salt is magnesium sulfate, usually employed as its heptahydrate (Epsom salts), but other hydrates thereof or the anhydride may be used too. Generally, the sulfates of the polyvalent metals will be used because the sulfate anion thereof is also the anion of some of the anionic detergents and is found in some such detergents as a byproduct of sulfation or sulfonation.

The cosurfactant component(s) of the microemulsion cleaners reduce the interfacial tension or surface tension between the lipophilic droplets and the continuous aqueous medium to a value that is often close to $10^{-3}$ dynes/cm., which results in spontaneous disintegrations of the dispersed phase globules until they become so small as to be invisible to the human eye, forming a clear microemulsion. In such a microemulsion the surface area of the dispersed phase increases greatly and its solvent power and grease removing capability are also increased, so that the microemulsion is significantly more effective as a cleaner for removing greasy soils than when the dispersed phase globules are of ordinary emulsion sizes. Among the cosurfactants that are useful in the invented cleaners are: aliphatic mono-, di- and tricarboxylic acids of 3 to 6 carbon atoms and hydroxy substituted derivatives thereof; water soluble lower alkanols, of 2 to 6 carbon atoms, sometimes preferably 3 or 4; polypropylene glycols of 2 to 18 propoxy units; monoalkyl lower glycol ethers of the formula $RO(X)_nH$, wherein R is $C_{1-4}$ alkyl, X is $CH_2CH_2O$, $CH_2CH(CH_3)O$, $CH_2CH_2CH_2O$ or $CH(CH_3)CH_2O$, and n is 1 to 4; monoalkyl esters of the formula $R^1O(X)_nH$, wherein $R^1$ is $C_{2-4}$ acyl and X and n are as immediately previously described; aryl substituted alkanols of 1 to 4 carbon atoms; propylene carbonate; lower alkyl mono-, di and triesters of phosphoric acid wherein the lower alkyl is of 1 to 4 carbon atoms; and mixtures thereof. Additional cosurfactants are described in U.S. patent application Ser. No. 07/120,250, mentioned previously, which description has been incorporated by reference. In employing the acidic cosurfactant(s) care will be exercised in selecting them so that those used are not so strong as to etch or mar European enamel surfaces of bathroom fixtures to be cleaned (when acidic cosurfactants are used).

Representative of the useful cosurfactants are glutaric, succinic, adipic, lactic, acetic, propionic, maleic, acrylic, tartaric, gluconic, ascorbic, citric and "nonionic" acids, diethylene glycol monobutyl ether, dipropylene glycol monobutyl ether and diethylene glycol monoisobutyl ether, of which the glutaric, adipic and succinic acids are most effective, especially in mixture.

Although the invented microemulsions are highly preferred and are most effective, "ordinary" emulsions are also within the invention, but cleaning will be less because of less intimate contact of the solvent materials of the dispersed phase of the cleaner with the surface being treated. Other forms of the compositions may also be used, such as gels, pastes, solutions, foams, and "aerosols", all of which include aqueous media.

In the invented cleaners it is important that the proportions of the components be in certain ranges so that the product may be most effective in removing greasy soils, lime scale and soap scum, and other deposits from the hard surfaces to be subjected to treatment, and so as to protect such surfaces during such treatment. As was previously mentioned, the detergent should be present in detersive proportion, sufficient to remove greasy and oily soils; the proportion(s) of organic acid(s) should be sufficient to remove soap scum and lime scale; the phosphoric and phosphonic acids mixture should be enough to prevent damage of acid sensitive surfaces by the organic acid(s); and the aqueous medium should be a solvent and suspending medium for the required components and for any adjuvants that may be present, too.

Normally, such percentages of components will be 3 to 14% of synthetic organic detergent(s), 2 to 10% of organic acid(s), 0.01 to 2% of aminoalkylenephosphonic acid(s), 0.05 to 5% of phosphoric acid and the balance of aqueous medium, including adjuvants, if present. Preferred formulas will include 2 to 8% of synthetic anionic organic detergent(s), 1 to 6% of synthetic organic nonionic detergent(s), 2 to 8% of organic acids (preferably aliphatic carboxylic diacids), 0.05 to 0.7% of phosphoric acid or mono-salt thereof, and 0.01 to 1% of aminoalkylenephosphonic acid(s) or monophosphonic salt(s) thereof; and the balance water and adjuvant(s), if any adjuvants are present. The ratios of aminoalkylenephosphonic acid to phosphoric acid to organic acid(s) are usually about 1:1–20; 20–500, preferably being 1:2–10:10–200. More preferably, such ratios are 1:4:25, 1:7:170 and 1:3:25, in three representative formulas. However, one may have ranges as wide as 1:1–2,000:10–4,000, and often the preferred ranges of the phosphonic acid to organic acid is 5:1 to 250:1 or to 1,000:1, that of phosphoric acid to organic acid is 100 to 1:1, and that of phosphoric acid to the phosphonic acid is 2:1 to 30:1.

Usually there will be present in the cleaner, especially when paraffin sulfonate is the detergent, 0.05 to 5%, and preferably 0.1 to 0.3% of polyvalent or multivalent metal (or metal ion), preferably magnesium or aluminum, and more preferably magnesium. Also, the percentage of perfume will normally be in the 0.2 to 2% range, preferably being in the 0.5 to 1.5% range, of which perfume at least 0.1% will normally be terpene or terpineol. The terpineol is alpha-terpineol and is preferably added to allow a reduction in the amount of perfume, with the total perfume (including the alpha-terpineol) being 50 to 90% of terpineol, preferably about 80% thereof.

For preferred formulas of the present cleaners, which are different in that one contains two anionic detergents and the other only one, the latter will contain 3 to 5% of sodium paraffin sulfonate wherein the paraffin is $C_{14-17}$, 2 to 4% of nonionic detergent which is a condensation product of a fatty alcohol of 9 to 15 carbon atoms with 3 to 15 moles of ethylene oxide per mole of higher fatty alcohol, 3 to 7% of a 1:1:1 or 2:5:1 mixture of succinic, glutaric and adipic acids, 0.1 to 0.3% of phosphoric acid, 0.03 to 0.1% of aminotris-(methylenephosphonic acid), 0.1 to 0.2% of magnesium ion, 0.5 to 2% of perfume, of which 50 to 90% thereof is alpha-terpineol, 0 to 5% of adjuvants and 75 to 90% of water. More preferably, such cleaner will comprise or consist essentially of about 4% of sodium paraffin ($C_{14-17}$) sulfonate, about 3% of the nonionic detergent, about 5% of 2:5:1 mix of the dicarboxylic acids, about 0.2% of phosphoric acid, about 0.05% of aminotris-(methylenephosphonic acid), about 1% of perfume, which includes about 0.8% of alpha-terpineol, about 0.7% of magnesium sulfate (anhydrous), about 3% of adjuvants and about 83% of water.

Another preferred formula comprises 0.5 to 2% of sodium paraffin sulfonate wherein the paraffin is $C_{14-17}$, 2 to 4% of sodium ethoxylated higher fatty alcohol sulfate wherein the higher fatty alcohol is of 10 to 14 carbon atoms and which contains 1 to 3 ethylene oxide groups per mole, 2 to 4% of nonionic detergent which is a condensation product of fatty alcohol of 9 to 15 carbon atoms with 3 to 15 moles of ethylene oxide per mole of fatty alcohol, 3 to 7% of a 1 : 1 : 1 mixture of succinic, glutaric and adipic acids, 0.1 to 0.3% of phosphoric acid, 0.01 to 0.05% of aminotris-(methylenephosphonic acid), 0.09 to 0.17% of magnesium ion, 0.5 to 2% of perfume, of which at least 10% is terpene(s) and/or terpineol, 0 to 5% of adjuvant(s) and 75 to 90% of water. More preferably, such cleaner, with two anionic detergents, will comprise or consist essentially of about 1% of sodium paraffin ($C_{14-17}$) sulfonate, about 3% of sodium ethoxylated higher fatty alcohol sulfate wherein the higher fatty alcohol is lauryl alcohol and the degree of ethoxylation is 2 moles of ethylene oxide per mole, about 3% of nonionic detergent which is a condensation product of a $C_{9-11}$ linear alcohol and 5 moles of ethylene oxide, about 5% of a 1:1:1 mixture of succinic, glutaric and adipic acids, about 0.2% of phosphoric acid, about 0.03% of aminotris-(methylenephosphonic acid), about 0.7% of magnesium sulfate (anhydrous), about 2% of adjuvants and about 84% of water.

The pH of the various preferred microemulsion cleaners is usually 1–4, preferably 1.5–3.5, and more preferably 2.5–3.5, e.g., 3. The water content of the microemulsions will usually be in the range of 75 to 90%, preferably 80 to 85%, and the adjuvant content will be from 0 to 5%, usually 1 to 3%. If the pH is not in the desired range it will usually be adjusted with either sodium hydroxide or other suitable alkaline agent, or a suitable acid, preferably as aqueous solutions thereof. Normally the pH will be raised, not lowered, and if it has to be lowered more of the dicarboxylic acid mixture can be used, instead, and thereby such pH adjustment can be obviated.

The cleaners of the invention, in microemulsion form, are clear oil in water (o/w) emulsions and exhibit stability at room temperature and at elevated and reduced temperatures, from 10° to 50° C. They are readily pourable and exhibit a viscosity in the range of 1 or 2 to 150 or 200 centipoises, e.g., 5 to 40 cp., as may be desired, with the viscosity being controllable, in part, by addition to the formula of a thickener, such as lower alkyl cellulose, e.g., methyl cellulose, hydroxypropyl methyl cellulose, or a water soluble resin, e.g., polyacrylamide, polyvinyl alcohol. Any tendency of the product to foam objectionably can be counteracted by incorporating in the formula an appropriate foam controlling agent, such as a silicone, e.g., dimethyl silicone, in minor proportion. Alternatively, a foam reducing nonionic detergent may be employed, such as Plurafac ®LF 132, which is an ethoxylated and propoxylated $C_{13-15}$ alcohol nonionic surfactant with a capped end group.

The liquid cleaners of the invention can be manufactured by mere mixing of the various components thereof, with orders of additions not being critical. However, it is desirable for the various water soluble components to be mixed together, the oil soluble components to be mixed together in a separate operation, and the two mixes to be admixed, with the oil soluble portion being added to the water soluble portion (in the water) with stirring or other agitation. In some instances such procedure may be varied to prevent any undesirable reactions between components. For example, one would not add concentrated phosphoric acid directly to magnesium sulfate or to a dye, but such additions would be of aqueous solution preferable dilute solutions, of the components.

The cleaner may desirably packed in manually operated spray dispensing container, which are usually and preferably made of synthetic organic polymeric plastic material, such as polyethylene, polypropylene or polyvinyl chloride (PVC). Such containers also preferably include nylon or other non-reactive plastic closure, spray nozzle, dip tube and associated dispenser parts, and the resulting packaged cleaner is ideally suited for use in "spray and wipe" applications. However, in some instances, as when lime scale and soap scum deposits are heavy, the cleaner may be left on until it has dissolved or loosened the deposits, and may then be wiped off, or may be rinsed off, or multiple applications may be made, followed by multiple removals, until the deposits are gone. For spray applications the viscosity of the microemulsion (or ordinary emulsion, if that is used instead) will desirably be increased so that the liquid adheres to the surface to be cleaned, which is especially important when such surface is vertical, to prevent immediate run-off of the cleaner and consequent loss of effectiveness. Sometimes, the product may be formulated as an "aerosol spray type", so that its foam discharged from the aerosol container will adhere to the surface to be cleaned. At other times the aqueous medium may be such as to result in a gel or paste, which is deposited on the surface by hand application, preferably with a sponge or cloth, and is removed by a combination of rinsing and wiping, preferably with a sponge, after which it may be left to dry to a shine, or may be dried with a cloth. Of course, when feasible, the cleaned surface may be rinsed to remove all traces of acid from it.

Although it is usually intended for the described formulas to be employed at the concentrations mentioned, without dilutions, it is within the invention to dilute them prior to use, and such diluted formulas that are operative are also within the invention. Correspondingly, more concentrated formulas, with the components in the same proportions as previously described, may be made and may be used as is in suitable applications, or may be diluted with up to 5 parts by weight of water before use, to make the described compositions The following examples illustrate but do not limit the invention. All parts, proportions and percentages in the examples, the specification and claims are by weight and all temperatures are in °C., unless otherwise indicated.

EXAMPLE 1

| Component | % (by weight) |
|---|---|
| Sodium paraffin sulfonate (paraffin of $C_{14-17}$) | 1.00 |
| Sodium lauryl ether sulfate (2 moles of ethylene oxide [EtO] per mole | 3.00 |
| $C_{9-11}$ linear alcohol ethoxylate nonionic detergent (5 moles of EtO per mole) | 3.00 |
| Magnesium sulfate heptahydrate (Epsom salts) | 1.35 |
| Succinic acid | 1.67 |
| Glutaric acid | 1.67 |
| Adipic acid | 1.67 |
| Aminotris-(methylenephosphonic acid) | 0.03 |
| Phosphoric acid | 0.20 |
| Perfume (contains about 40% terpenes) | 1.00 |
| Dye (1% aqueous solution of blue dye) | 0.10 |
| Sodium hydroxide (50% aqueous solution; decrease water amount by amount of NaOH solution used) | q.s. |
| Water (deionized) | 85.31 |
| | 100.00 |

The microemulsion cleaner is made by dissolving the detergents in the water, after which the rest of the water soluble materials are added to the detergent solution, with stirring, except for the perfume and the pH adjusting agent (sodium hydroxide solution). The pH is adjusted to 3.0 and then the perfume is stirred into the aqueous solution, instantaneously generating the desired microemulsion, which is clear blue, and of a viscosity in the range of 2–20 cp. If the viscosity is too low or if it is considered desirable for it to be increased there is incorporated in the formula about 0.1 to 1%, e.g., 0.5%, of a suitable gum or resin, such as sodium carboxymethyl cellulose (CMC) or hydroxypropylmethyl cellulose, or polyacrylamide or polyvinyl alcohol, or a suitable mixture thereof.

The acid cleaner is packed in polyethylene squeeze bottles equipped with polypropylene spray nozzles, which are adjustable to closed, spray and stream positions. In use, the microemulsion is sprayed onto "bathtub ring" on a bathtub, which also includes lime scale, in addition to soap scum and greasy soil. The rate of application is about 5 ml. per 5 meters of ring (which is about 3 cm. wide). After application and a wait of about two minutes the ring is wiped off with a sponge and is sponged off with water. It is found that the greasy soil, soap scum, and even the lime scale, have been removed effectively. In those cases where the lime scale is particularly thick or adherent a second application may be desirable, but that is not considered to be the norm.

The tub surface may be rinsed because it is so easy to rinse a bathtub (or a shower) but such rinsing is not necessary. Sometimes dry wiping will be sufficient but if it is desired to remove any acidic residue the surface may be sponged with water or wiped with a wet cloth, but in such case it is not necessary to use more than ten times the weight of cleaner applied. In other words, the surface does not need to be thoroughly doused or rinsed with water, and it still will be clean and shiny (providing that it was originally shiny). In other uses of the cleaner, it is employed to clean shower tiles, bathroom floor tiles, kitchen tiles, sinks and enamelware, generally, without harming the surfaces thereof. It is recognized that many of such surfaces are acid-resistant but a commercial product must be capable of being used without harm on even less resistant surfaces, such as European white enamel (often on a cast iron or sheet steel base), which is sometimes referred to as zirconium white powder enamel. It is a feature of the cleaner described above (and other cleaners of this invention) that they clean hard surfaces effectively, but they do contain ionizable acids and therefore should not be applied to acid-sensitive surfaces. Nevertheless, it has been found that they do not harm European white enamel bathtubs, in this example, which are seriously etched and dulled by cleaning with preparations exactly like that of this example except for the omission from them of the phosphonic-phosphoric acid mixture.

The major component of the formulation that protects the European enamels is the phosphonic acid, and in the formula the amount of such acid has been reduced below the minimum normally required at a pH of 3. Yet, although 0.5% or 0.6% is the normal minimum, when the phosphoric acid is present, which is ineffective in itself at such pH, it increases the effect of the phosphonic acid, allowing a significant reduction in the proportion of the more expensive phosphonic acid.

In variations of the described formula, all components are kept the same and in the same proportions except for water, and phosphonic and phosphoric acids. In Experiment 1a, 0.05% of aminotris-(methylenephosphonic acid) is employed and the phosphoric acid is omitted; in Experiment 1b, 0.5% of ethylene diamine tetra-(methylenephosphonic acid) is employed, with no phosphoric acid; in Experiment 1c, 0.5% of hexamethylene diamine tetra-(methylenephosphonic acid) is used, with no phosphoric acid; in Experiment 1d, 0.4% of diethylene triamine penta-(methylenephosphonic acid) is present, without phosphoric acid; and in Experiment 1e, 0.10% of diethylene triamine penta-(methylenephosphonic acid) is employed, with 0.60% of phosphoric acid. The cleaning powers of formulas 1d and 1e are about equivalent, showing that the presence of the phosphoric acid, essentially inactive as a protector of surfaces against the effects of the carboxylic acids present in the formula, decreases the proportion of phosphonic acid to protect the surfaces to ¼ of that previously necessary. Similar effects are obtainable when phosphoric acid is used in the 1b and 1c formulas in about the same proportions as in Example 1 and Example 1e. If excessive foaming is encountered in use of the cleaner one may add an anti-foaming agent such as a silicone, e.g., dimethyl silicone, or the nonionic detergent may be replaced with Plurafac LF 132. Alternatively, coco-diethanolamide may be added to increase foaming, if that is desired.

EXAMPLE 2

| Component | % (by weight) |
|---|---|
| Sodium paraffin sulfonate ($C_{14-17}$ paraffin) | 4.00 |
| Nonionic detergent (condensation product of one mole of fatty $C_{9-11}$ alcohol and 5 moles EtO) | 3.00 |
| Magnesium sulfate heptahydrate | 1.50 |
| Mixed succinic, glutaric and adipic acids (1:1:1) | 5.00 |
| Aminotris-(methylenephosphonic acid) | 0.03 |
| Phosphoric acid | 0.20 |
| Perfume | 1.00 |
| Dye (1% aqueous solution of blue dye) | 0.05 |
| Sodium hydroxide (50% aqueous solution; decrease water amount by amount of NaOH solution used) | q.s. |
| Water, deionized | 85.22 |
| | 100.00 |

Compositions of this example are made in the same manner as those of Example 1 and are tested in the same way, too, with similar good results. The microemulsions are a clear lighter blue and the pH thereof is adjusted to 3.0. The cleaners easily remove soap scum and greasy soils from hard surfaces and loosen and facilitate removal of lime scale, too, with minimal rinsing or spongeing, as reported in Example 1. The presence of the aminotris-(methylenephosphonic acid) prevents harm to the acid sensitive surfaces by the carboxylic acids, and the presence of the phosphoric acid allows a reduction in the proportion of aminotris-(methylenephosphonic acid) to that which is used. For example, in a modified Example 2, designated 2a, without any phosphoric acid present it takes 0.10% of the aminotris-(methylenephosphonic acid) to prevent harm to a certain European enamel by the cleaning composition. Similarly, in Example 2b, wherein the formula is the same as Example 2 except that the phosphonic and phosphoric acids are replaced by 0.20% of aminoalkylene phosphonic acid (diethylene triamine penta-(methylenephosphonic acid) and 0.6% of phosphoric acid, European enamel is unharmed, whereas to obtain the same desirable effect without the phosphoric acid present requires 0.50% of that phosphonic acid. Similar results are obtained when the 0.5% of the phosphonic acid is replaced by the same proportion of ethylene diamine tetra(methylenephosphonic acid) or hexamethylene diamine tetra(methylenephosphonic acid), or with 0.2% and 0.5% of the aminoalkylene phosphonic acid and phosphoric acid respectively.

Thus, from this example (and Examples 1 and 2) it is seen that phosphoric acid, which is essentially ineffective to protect acid-sensitive surfaces against actions of carboxlyic acids in the present cleaners, improves the protective effects of phosphonic acids, and does so significantly for European bathtub enamel, which otherwise would be damaged by the described cleaners.

EXAMPLE 3

| Component | % (by weight) |
|---|---|
| Deionized water | 82.339 |
| $C_{14-17}$ paraffin sodium sulfonate (60% active, Hostapur SAS) | 6.670 |
| * Mixture of glutaric, succinic and adipic acids (mf'd. by DuPont) | 5.000 |
| Nonionic detergent (Plurafac LF 400, ethoxypropoxy higher fatty alcohol, mf'd. by BASF) | 3.000 |
| Epsom salts | 1.500 |
| Aminotris-(methylenephosphonic acid) | 0.050 |
| Phosphoric acid (85%) | 0.230 |
| Perfume (pine scent type, containing terpenes) | 0.200 |
| Alpha-terpineol (perfume substitute) | 0.800 |
| Formalin (preservative) | 0.200 |
| 2,6-Di-tert-butyl-para-cresol (antioxidant) | 0.010 |
| CI Acid Blue 104 dye | 0.001 |
| | 100.000 |

* 57.5% glutaric acid, 27% succinic acid and 12% of adipic acid

The above formula is made in the manner previously described and is similarly tested and found satisfactorily to clean acid sensitive hard surfaced items, such as tubs and sinks of cast iron or sheet steel coated with European enamel, of greasy soils on them, and to facilitate removals of soap scums and lime scales from such surfaces. When the phosphonic and phosphoric acids are omitted from the formula, or when either one of these acids is omitted, the cleaner attacks such surfaces and dissolves them. The presence of the phosphoric acid allows a reduction in the proportion of the phosphonic acid that is required to inhibit the cleaner so that it will not attack the European enamels, and that reduction is significant, especially for economic reasons, but also functionally. The alpha-terpineol replaces some of the perfume and helps in the formation of the microemulsion, while not destroying the pleasant scent that the perfume imparts to the product, and such results are obtainable with other pine-type perfumes. The alpha-terpineol, like the terpene components of a pine-type perfume, facilitates microemulsion formation, but the terpineol is even more active because it is essentially 100% of terpene type compound, whereas the perfumes are usually less than 50% of terpenes.

EXAMPLE 4

| Component | % (by weight) |
|---|---|
| Sodium paraffin sulfonate ($C_{14-17}$ paraffin) | 4.0 |
| $C_{13-15}$ fatty alcohol ethoxylate nonionic detergent (7 moles of EtO and 4 moles of propylene oxide [PrO] per mole) | 3.0 |
| $MgSO_4.7H_2O$ | 1.5 |
| Perfume | 0.8 |
| Aminotris-(methylenephosphonic acid), referred to as APA | see below |
| Phosphoric Acid | see below |
| Organic Acid (main acidifying component) | see below |
| Water | q.s. |
| | 100.0 |

In the above formulas of acidic cleaning microemulsions organic acids and anticorrosion systems described below were included. The cleaning compositions were made and tested in the manners described in Example 1. Visual evaluations and gloss readings are given below.

TABLE 1

| Acids | Anticorrosion system | | Gloss value | Gloss loss | Visual rating |
|---|---|---|---|---|---|
| 5% lactic acid | — | Before treatment | 96 | | |
| | % | After 30 min. | 24 | 75 | V.A. |
| | 0.4 aminophosphonic acid (APA) + | B.T. | 92 | | |
| | 0.4 phosphoric acid | After 30 min. | 92 | 0 | N.V.A. |
| | 0.8 APA | B.T. | 98 | | |
| | | After 30 min. | 51 | 48 | V.A. |
| | 0.8 phosphoric acid | B.T. | 94 | | |
| | | After 30 min. | 52 | 45 | V.A. |
| 5% acetic acid | — | B.T. | 97 | | |
| | | After 30 min. | 36 | 63 | V.A. |
| | 0.03 APA + | B.T. | 104 | | |
| | 0.2 phosphoric acid | After 30 min. | 104 | 0 | N.V.A. |
| | 0.23 APA | B.T. | 99 | | |
| | | After 30 min. | 50 | 49 | V.A. |
| | 0.23 phosphoric acid | B.T. | 106 | | |
| | | After 30 min. | 53 | 50 | V.A. |
| 5% propionic acid | — | | 87 | | |
| | | After 30 min. | 33 | 62 | V.A. |
| | 0.03 APA + | Before Treatment | 92 | | |
| | 0.2 phosphoric acid | After 30 min. | 92 | 0 | N.V.A. |
| | 0.23 APA | B.T. | 89 | | |
| | | After 30 min. | 45 | 49 | V.A. |
| | 0.23 phosphoric acid | B.T. | 91 | | |
| | | After 30 min. | 38 | 58 | V.A. |
| 3% maleic acid | — | B.T. | 95 | | |
| | | After 30 min. | 40 | 58 | V.A. |
| | 0.03 APA + | B.T. | 92 | | |
| | 0.20 phosphoric acid | After 30 min. | 92 | 0 | N.V.A. |
| | 0.23 APA | B.T. | 106 | | |

TABLE 1-continued

| Acids | Anticorrosion system | | Gloss value | Gloss loss | Visual rating |
|---|---|---|---|---|---|
| | | After 30 min. | 73 | 31 | V.A. |
| | 0.23 phosphoric acid | B.T. | 97 | | |
| | | After 30 min. | 65 | 33 | V.A. |
| 5% acrylic acid | — | Before Treatment | 96 | | |
| | | After 30 min. | 48 | 50 | V.A. |
| | 0.03 APA + | B.T. | 94 | | |
| | 0.2 phosphoric acid | After 30 min. | 94 | 0 | N.V.A. |
| | 0.23 APA | B.T. | 101 | | |
| | | After 30 min. | 77 | 24 | V.A. |
| | 0.23 phosphoric acid | B.T. | 103 | | |
| | | After 30 min. | 68 | 34 | V.A. |
| 5% tartaric acid | — | B.T. | 99 | | |
| | | After 30 min. | 35 | 65 | V.A. |
| | 0.4 APA + | B.T. | 97 | | |
| | 0.5 phosphoric acid | After 30 min. | 97 | 0 | N.V.A. |
| | 0.9 APA | B.T. | 105 | | |
| | | After 30 min. | 71 | 32 | V.A. |
| | 0.9 phosphoric acid | B.T. | 98 | | |
| | | After 30 min. | 23 | 77 | V.A. |
| 5% gluconic acid | — | B.T. | 97 | | |
| | | After 30 min. | 34 | 65 | V.A. |
| | 0.05 APA + | B.T. | 93 | | |
| | 0.4 phosphoric acid | After 30 min. | 93 | 0 | N.V.A. |
| | 0.45 APA | B.T. | 107 | | |
| | | After 30 min. | 82 | 23 | V.A. |
| | 0.45 phosphoric acid | B.T. | 104 | | |
| | | After 30 min. | 45 | 57 | V.A. |
| 5% ascorbic acid | — | B.T. | 96 | | |
| | | After 30 min. | 16 | 83 | V.A. |
| | 0.03 APA + | B.T. | 92 | | |
| | 0.2 phosphoric acid | After 30 min. | 92 | 0 | N.V.A. |
| | 0.23 APA | B.T. | 95 | | |
| | | After 30 min. | 75 | 21 | V.A. |
| | 0.23 phosphoric acid | B.T. | 97 | | |
| | | After 30 min. | 74 | 24 | V.A. |
| 5% citric acid | — | | 99 | | |
| | | After 30 min. | 39 | 61 | V.A. |
| | 0.4 APA + | B.T. | 93 | | |
| | 0.5 phosphoric acid | After 30 min. | 93 | 0 | N.V.A. |
| | 0.9 APA | B.T. | 99 | | |
| | | After 30 min. | 58 | 41 | V.A. |
| | 0.9 phosphoric acid | B.T. | 102 | | |
| | | After 30 min. | 36 | 65 | V.A. |
| 5% C12-14 | — | B.T. | 85 | | |
| $(EO)_5OCH_2$—COOH | | After 30 min. | 15 | 82 | V.A. |
| (Akypo | 0.03 APA + | B.T. | 99 | | |
| RLM 45 | 0.2 phosphoric acid | After 30 min. | 99 | 0 | N.V.A. |
| ex Chemy) | 0.23 APA | B.T. | 89 | | |
| | | After 30 min. | 74 | 17 | V.A. |
| | 0.23 phosphoric acid | B.T. | 91 | | |
| | | After 30 min. | 74 | 19 | V.A. |

In the compositions made and tested, as described above, all were at a pH of 3, having been adjusted to that pH by addition of aqueous NaOH.

From the data given it is clear that the presence of the combination of APA and phosphoric acid in the compositions prevented attack (NVA) on the European enamel by the cleaner's organic acid, for a variety of such organic acids, whereas the cleaners without either the APA or the phosphoric acid or without both of them caused visible attack (VA). Gloss readings before and after cleanings confirm the real differences between the cleaners.

In addition to the results reported above, it should be mentioned that valeric acid and sorbic acid were also tried in the given formula. However, valeric acid caused phase separation and therefore was not worked on further, and sorbic acid was insufficiently soluble in the aqueous medium (although it could be employed together with more soluble organic acid) and therefore work on it was also suspended. The anti-etching system of APA and phosphoric acid was ineffective against oxalic and malonic acids in the given formula, apparently because such acids are too strong for use in the present cleaners (and are outside the present invention).

The levels of concentrations of the APA and the phosphoric acid in the described cleaning compositions are preferred levels because they are effective and are near minimum effective levels. Of course, larger proportions of such anti-etching components may be included, and will also be effective, but APA and other aminoalkylenephosphonic acids are expensive and so an economic price has to be paid for use of more than is required, so near-minimum levels are usually employed. Also, because of regulatory restrictions and clearance delays sometimes encountered it will often be advantageous to employ "safe" organic acids, such as accepted food acids, e.g., citric and acetic acids (from lemon juice and vinegar).

EXAMPLE 5

This example illustrates the employment of various ratios and concentrations of the anti-etching components of this invention. All compositions tested were at pH 3. From the data it is seen that for the European enamel tile samples employed all suffered visible attack by the cleaning composition unless they contained APA and even when APA was present, unless phosphoric acid was also present with it the tiles would still be attacked, unless the percentage of APA was increased to more than 0.5% (0.62% results in no visible attack). It should be noted here that due to different hardnesses of the European enamel, as applied to different surfaces, etc., there are variations observed in concentrations of the anti-etching components that are effective. However, such variations are relatively small and the combination, in the claimed formulas, clearly prevents damage to European enamels.

The following table summarizes the formulas made and tested, and the results obtained.

TABLE 2

| | | | | | | | | | | | | | | |
|---|---|---|---|---|---|---|---|---|---|---|---|---|---|---|
| Sodium paraffin sulfonate | 1 | 1 | 1 | 1 | 1 | 1 | 1 | 1 | 1 | 1 | 1 | 1 | 1 | 1 |
| Sodium lauryl ether sulfate | 3 | 3 | 3 | 3 | 3 | 3 | 3 | 3 | 3 | 3 | 3 | 3 | 3 | 3 |
| $C_9$-$C_{11}$ alcohol ethoxylate 5 EtO/mole | 3 | 3 | 3 | 3 | 3 | 3 | 3 | 3 | 3 | 3 | 3 | 3 | 3 | 3 |
| Succinic/glutaric/adipic acid mixture | 5 | 5 | 5 | 5 | 5 | 5 | 5 | 5 | 5 | 5 | 5 | 5 | 5 | 5 |
| $MgSO_4$ $7H_2O$ | 1.35 | 1.35 | 1.35 | 1.35 | 1.35 | 1.35 | 1.35 | 1.35 | 1.35 | 1.35 | 1.35 | 1.35 | 1.35 | 1.35 |
| Aminotris (methylene phosphonic acid) | 0.02 | 0.12 | — | 0.17 | 0.27 | — | 0.08 | 0.38 | — | 0.02 | 0.42 | — | 0.12 | 0.52 |
| Phosphoric acid | 0.1 | — | 0.12 | 0.1 | — | 0.27 | 0.3 | — | 0.38 | 0.4 | — | 0.42 | 0.4 | — |
| Water/perfume | QS | QS | QS | QS | QS | QS | QS | QS | QS | QS | QS | QS | QS | QS |
| Appearance of European enamel after 30' contact | NVA | VA | VA | NVA | VA | VA | NVA | VA | VA | NVA | VA | VA | NVA | VA |
| Gloss meter readings | | | | | | | | | | | | | | |
| Inital | 94 | 90 | 91 | 90 | 92 | 87 | 94 | 93 | 98 | 93 | 92 | 90 | 101 | 98 |
| After 30' contact | 94 | 52 | 52 | 90 | 60 | 48 | 92 | 59 | 80 | 90 | 75 | 68 | 99 | 84 |
| Sodium paraffin sulfonate | 1 | 1 | 1 | 1 | 1 | 1 | 1 | 1 | 1 | 1 | 1 | 1 | 1 | 1 |
| Sodium lauryl ether sulfate | 3 | 3 | 3 | 3 | 3 | 3 | 3 | 3 | 3 | 3 | 3 | 3 | 3 | 3 |
| $C_9$-$C_{11}$ alcohol ethoxylate 5 EtO/mole | 3 | 3 | 3 | 3 | 3 | 3 | 3 | 3 | 3 | 3 | 3 | 3 | 3 | 3 |
| Succinic/glutaric/adipic acid mixture | 5 | 5 | 5 | 5 | 5 | 5 | 5 | 5 | 5 | 5 | 5 | 5 | 5 | 5 |
| $MgSO_4$ $7H_2O$ | 1.35 | 1.35 | 1.35 | 1.35 | 1.35 | 1.35 | 1.35 | 1.35 | 1.35 | 1.35 | 1.35 | 1.35 | 1.35 | 1.35 |
| Aminotris (methylene phosphonic acid) | — | 0.02 | 0.62 | — | 0.08 | 0.68 | — | 0.02 | 0.82 | — | 0.15 | 0.95 | — | |
| Phosphoric acid | 0.52 | 0.6 | — | 0.62 | 0.6 | — | 0.68 | 0.8 | — | 0.82 | 0.8 | — | 0.95 | |
| Water/perfume | QS | QS | QS | QS | QS | QS | QS | QS | QS | QS | QS | QS | QS | QS |
| Appearance of European enamel after 30' contact | VA | NVA | NVA | VA | NVA | NVA | VA | VA | NVA | VA | NVA | NVA | VA | |
| Gloss meter readings | | | | | | | | | | | | | | |
| Inital | 98 | 89 | 92 | 88 | 92 | 92 | 91 | 89 | 106 | 100 | 93 | 90 | 87 | |
| After 30' contact | 75 | 89 | 83 | 47 | 91 | 89 | 68 | 62 | 99 | 59 | 91 | 75 | 60 | |

EXAMPLE 6

The following experiments, 6A-6N, the formulas and results for which are given in Table 3, which follows, are ones that demonstrate that the present invention is operative and successful with a variety of the main organic acids, and with different proportions of APA to phosphoric acid and with different total proportions of the combination of anti-etching agents. Also pH's were changed, to show that the invention is operative at various pH's.

The only formulations that exhibit etching after contacting the test tiles for thirty minutes are those including gluconic acid and citric acid. However, it is seen from Examples 6I, 6J, 6M and 6N that the formulas of Examples 6H and 6L can be improved and can be acceptable by relatively small changes of pH or of APA or phosphoric acid contents. Such modifications of conditions are considered to be within one of skill in the art and it is expected that one following the teachings of this specification will make similar adjustments in the invented formulas in the event that certain European enamel wares which may be more susceptible to attack by organic acids in cleaners are to be cleaned with the invented products.

TABLE 3

| | A | B | C | D | E | F | G | H | I | J | K | L | M | N |
|---|---|---|---|---|---|---|---|---|---|---|---|---|---|---|
| Water | Bal. | Bal. | Bal. | Bal. | Bal. | Bal. | Bal. | Bal. | Bal. | Bal. | Bal. | Bal. | Bal. | Bal. |
| Sodium paraffin sulfonate | 4 | 3 | 3 | 3 | 3 | 2 | | 4 | 4 | 4 | 2 | 4 | 4 | |
| Sodium lauryl ether sulfate 2EO | | | | | | 2 | | | | | 2 | | | |
| Dodecyl benzene sulfonic acid | | | | | | | 5 | | | | | | | 5 |

TABLE 3-continued

| | A | B | C | D | E | F | G | H | I | J | K | L | M | N |
|---|---|---|---|---|---|---|---|---|---|---|---|---|---|---|
| $C_{13-15}$ fatty alcohol EO 10:1 PO 5:1 | | | | | | | 5 | | | | | | | 5 |
| $C_{13-15}$ fatty alcohol EO 7:1 PO 4:1 | 3 | | | | | | | 3 | 3 | 3 | | 3 | 3 | |
| $C_{9-11}$ fatty alcohol EO 8:1 | | 3 | 3 | | | 3 | | | | | 3 | | | |
| $C_{9-11}$ fatty alcohol EO 5:1 | | | | 3 | 3 | | | | | | | | | |
| $MgSO_4$ $7H_2O$ | 1.5 | 1.5 | 1.5 | 1.5 | 1.5 | 1.5 | 1.5 | 1.5 | 1.5 | 1.5 | 1.5 | 1.5 | 1.5 | 1.5 |
| Acrylic acid | 5 | | | | | | | | | | | | | |
| Akypo RLM45 | | 5 | | | | 3 | | | | | | | | |
| Ascorbic acid | | | 5 | 5 | | | | | | | | | | |
| Acetic acid | | | | | 5 | | | | | | | | | |
| Propionic acid | | | | | | | 6 | | | | | | | |
| Gluconic acid | | | | | | | | 5 | 5 | 5 | 4 | | | |
| Citric acid | | | | | | | | | | | | 5 | 5 | 3 |
| Amino phosphonic acid | 0.04 | 0.06 | 0.08 | 0.05 | 0.03 | 0.04 | 0.1 | 0.05 | 0.05 | 0.1 | 0.06 | 0.4 | 0.4 | 0.5 |
| $H_3PO_4$ | 0.2 | 0.2 | 0.2 | 0.2 | 0.2 | 0.3 | 0.2 | 0.4 | 0.4 | 0.4 | 0.3 | 0.5 | 0.5 | 0.4 |
| Madras perfume | 0.8 | 0.8 | 0.8 | 0.3 | 0.7 | 0.8 | 0.8 | 0.8 | 0.8 | 0.8 | 0.8 | 0.8 | 0.8 | 0.8 |
| pH | 3.5 | 2.5 | 2.5 | 3 | 3 | 3 | 3 | 3.5 | 3 | 3.5 | 3 | 3.5 | 3 | 3 |
| Attack after 30 min. | NVA | NVA | NVA | NVA | NVA | NVA | NVA | VA | NVA | NVA | NVA | VA | NVA | NVA |
| Glossmeter readings before treatment | 98 | 99 | 91 | 89 | 99 | 96 | 92 | 44 | 93 | 93 | 90 | 51 | 90 | 91 |
| Glossmeter readings after treatment | 95 | 98 | 91 | 88 | 96 | 94 | 91 | 89 | 93 | 92 | 89 | 89 | 90 | 91 |

EXAMPLE 7

When variations are made in the formulas given above, by substituting, different detergents, of the types described herein, for those specifically illustrated in the working examples, by utilizing other polyvalent salts (or omitting them), by employing other adjuvants, such as solvents, intended to improve quiescent cleanings, by changing the pH, and by using other aminoalkylene-phosphonic acids, and by varying the proportions of the various components ±10%, 20% and 30%, within the ranges given in the specification, useful microemulsion cleaners are obtainable that will satisfactorily clean hard surfaces, removing soap scum and lime scale from them, without damaging such surfaces, even when the surfaces are of European enamel or zirconium white enamel. The products are very preferably in microemulsion form but even if the microemulsion should break to an ordinary emulsion, they will be useful as gentle cleaners for soap scums and lime scales, so such emulsions are also within the invention. The invention also extends to concentrated and diluted versions thereof. It may be preferred to dispense the cleaner from a spray bottle but it can also be packaged in conventional containers. It may be made in paste or gel form so as to make it more adherent to vertical surfaces to which it may be applied, so that it will stay in contact with them longer, instead of running down off them, thereby attacking the lime scale and soap scum for longer times. Although it has been mentioned that mixed components may be employed, even where individual components are specifically mentioned it is to be understood that such references are also to mixtures, and it is not required that only pure components be employed.

In all the compositions of the previous examples the addition of a foam controlling or foam reducing nonionic detergent like that previously described, such as Plurafac LF 132, is useful to prevent excessive foaming of the cleaner, which foaming can be particularly disadvantageous when the anionic detergent present is a high foaming surfactant, and when the application of the cleaner is by a means that is foam-intolerant, such as a spray bottle. The foam controlling proportion of the mentioned nonionic surfactant employed will usually be in the range of 5 to 100% of the nonionic detergent content of the cleaner, preferably being 10 to 30% thereof, e.g., about 20%.

The invention which is the subject of this application has been described with respect to illustrations and preferred embodiments thereof but is not to be limited to them because one of ordinary skill in the art, with the benefit of applicants' specification and teachings before him or her, will be able to utilize substitutes and equivalents without departing from the invention.

What is claimed is:

1. An acidic aqueous cleaner for bathtubs and other hard surfaces items which are acid resistant or are of zirconium white enamel, which cleaner is of a pH in the range of 1 to 4, and which removes lime scale, soap scum and greasy soil from surfaces of such items without damaging such surfaces, which comprises 3 to 14% of synthetic organic detergent(s) selected from the group consisting of anionic and nonionic detergents and mixtures thereof, 2 to 10% of organic acids(s) having 2 to 10 carbon atoms therein, which group of acids excludes oxalic and malonic acids, 0.01 to 2% of aminoalkylene phosphonic acid(s) and 0.05 to 5% of phosphoric acid, with the balance of the cleaner being an aqueous medium, with the proportions of the aminoalkylenephosphonic, phosphoric and organic acids being in the range of 1:1-2,000:10-4,000, in which proportions the combination of aminoalkylenephosphonic and phosphoric acids synergistically prevents damage to zirconium white enamel surfaces of items to be cleaned of lime scale, soap scum and greasy soil by the synthetic organic detergent and organic acid.

2. An acidic aqueous liquid cleaner according to claim 1, which is in emulsion form and in which the ratio of phosphoric acid to aminoalkylenephosphonic acid is in the range of 2:1 to 30:1 and the ratio of organic acid to phosphoric acid is in the range of 1:1 to 100:1.

3. An acidic aqueous cleaner according to claim 2 wherein the organic acid(s) is/are aliphatic and of carbon atoms content in the range of 3 to 8 and the aminoalkylenephosphonic acid contains 1 to 3 amino nitrogen(s), 3 to 5 lower alkylene phosphonic acid groups and 0 to 2 lower alkylene groups of 2 to 6 carbon atoms each, which alkylene(s) is/are present and connect(s) amino nitrogens when a plurality of such nitrogens is present in the aminoalkylenephosphonic acid.

4. An acidic aqueous cleaner according to claim 3, which is in microemulsion form and in which the ratio of organic acid(s) to aminoalkylenephosphonic acid is in the range of 10:1 to 1,000:1.

5. An acidic aqueous microemulsion cleaner according to claim 4 wherein the synthetic organic detergent is an anionic, nonionic or a mixture of anionic and nonionic detergents, wherein the anionic detergent(s) is/are water soluble salt(s) of lipophilic organic sulfonic acid(s) and/or water soluble salt(s) of lipophilic organic sulfuric acid(s) and the nonionic detergent is a condensation product of a lipophilic alcohol or a phenol with lower alkylene oxide, and wherein the aminoalkylenephosphonic acid is selected from the group consisting of aminotris-(methylenephosphonic acid), ethylenediamine tetra-(methylenephosphonic acid), hexamethylene diamine tetra-(methylenephosphonic acid), and diethylenetriamine penta-(methylenephosphonic acid), and mixtures thereof.

6. An acidic microemulsion cleaner according to claim 5 which comprises 2 to 8% of synthetic organic anionic detergent(s), 1 to 6% of synthetic organic nonionic detergent(s), 2 to 10% of the aliphatic organic acid(s), 0.05 to 0.7% of phosphoric acid and 0.01 to 1% of the aminoalkylenephosphonic acid(s).

7. An acidic microemulsion cleaner according to claim 6 wherein the aliphatic organic acid(s) is/are of carbon atom content(s) in the range of 3 to 6.

8. An acidic microemulsion cleaner according to claim 7 wherein the aliphatic organic acid(s) is/are dicarboxylic acid(s) of 4 to 6 carbon atoms.

9. An acidic microemulsion cleaner according to claim 8 wherein the synthetic organic anionic detergent is selected from the group consisting of water soluble higher paraffin sulfonate and water soluble ethoxylated higher fatty alcohol sulfate having 1 to 10 ethylene oxide groups per mole, and mixtures thereof, the nonionic detergent is a condensation product of a fatty alcohol of 9 to 15 carbon atoms with from 3 to 15 moles of lower alkylene oxide per mole of higher fatty alcohol, the dicarboxylic acid(s) is a mixture of succinic, glutaric and adipic acids in proportions of 0.8–4:0.8–10:1, respectively, the aminoalkylenephosphonic acid is amino-tris-(methylenephosphonic acid) and there are present in the cleaner 0.05 to 0.5% of magnesium and/or aluminum and 0.2 to 2% of perfume material.

10. An acidic liquid microemulsion cleaner according to claim 9 which is of a pH in the range of 2.5 to 3.5 and which comprises 3 to 5% of sodium paraffin sulfonate wherein the paraffin is $C_{14-17}$, 2 to 4% of nonionic detergent which is a condensation product of a fatty alcohol of 9 to 15 carbon atoms with 3 to 15 moles of lower alkylene oxide per mole of higher fatty alcohol, 3 to 7% of the mixture of succinic, glutaric and adipic acids, 0.1 to 0.3% of phosphoric acid, 0.03 to 0.1% of aminotris-(methylenephosphonic acid), 0.05 to 0.5% of magnesium, 0.5 to 2% of perfume, of which 50 to 90% thereof is alpha-terpineol, 0 to 5% of adjuvants and 75 to 90% of water.

11. An acidic microemulsion cleaner according to claim 9 which is of a pH in the range of 2.5 to 3.5 and which comprises 0.5 to 2% of sodium paraffin sulfonate wherein the paraffin is $C_{14-17}$, 2 to 4% of sodium ethoxylated higher fatty alcohol sulfate which contains from 1 to 3 ethylene oxide groups per mole and wherein the higher fatty alcohol is of 10 to 14 carbon atoms, 2 to 4% of nonionic detergent which is a condensation product of fatty alcohol of 9 to 15 carbon atoms with 3 to 15 moles of ethylene oxide per mole of higher fatty alcohol, 3 to 7% of the mixture of succinic, glutaric and adipic acids, 0.1 to 0.3% of phosphoric acid, 0.01 to 0.05% of aminotris-(methylenephosphonic acid), 0.05 to 0.2% of magnesium, 0.5 to 2% of perfume, of which at least 10% is terpene(s) and/or terpineol, 0 to 5% of adjuvant(s) and 75 to 90% of water.

12. An acidic cleaner according to claim 1 wherein the organic acid(s) is/are aliphatic dicarboxylic acid(s).

13. An acidic cleaner according to claim 1 wherein the organic acid(s) is/are saturated monocarboxylic acid(s), unsaturated dicarboxylic acid(s), saturated tri-or higher carboxylic acid(s), unsaturated monocarboxylic acid(s), unsaturated tri-or higher carboxylic acid(s), alicyclic unsaturated dihydroxy acid(s), poly-lower alkoxylated higher aliphatic acid(s), or any mixture of two or more thereof.

14. An acidic cleaner according to claim 13 wherein the organic acid(s) is/are acetic acid, propionic acid, citric acid, acrylic acid, maleic acid, lactic acid, gluconic acid, ascorbic acid, malic acid, tartaric acid, or any mixture thereof.

15. A process for removing any one or more of lime scale, soap scum, and greasy soil from bathtubs or other hard surfaced items, which are acid resistant or are of zirconium white enamel, which comprises applying to such a surface a composition in accordance with claim 1, and removing such composition and the lime scale and/or soap scum and/or greasy soil from such surface.

16. A process for removing any one or more of lime scale, soap scum, and greasy soil from bathtubs or other hard surfaced items, which are of zirconium white enamel, which comprises applying to such a surface a composition in accordance with claim 7, and removing such composition and the lime scale and/or soap scum and/or greasy soil from such surface.

17. A concentrated aqueous liquid cleaner for bathtubs and other hard surfaced items which are acid resistant or are of zirconium white enamel, which, when diluted with 1 to 5 parts by weight of water to one part of such concentrated cleaner, results in a cleaning composition according to claim 1.

18. An acidic aqueous liquid cleaner according to claim 1, which is in emulsion form and which contains a foam controlling proportion of a foam reducing nonionic detergent which is a condensation product of a higher fatty alcohol with ethylene oxide and propylene oxide.

19. A cleaner according to claim 18, which is in microemulsion form and in which the foam reducing nonionic detergent is from 5 to 100% of the nonionic detergent content of the cleaner and is a condensation product of one mole of a higher fatty alcohol of 12 to 16 carbon atoms with 3 to 12 moles of ethylene oxide and 2 to 7 moles of propylene oxide.

20. A cleaner according to claim 19 wherein the foam reducing nonionic detergent is 10 to 30% of the nonionic detergent content of the cleaner and is a condensation product of a higher fatty alcohol of 13 to 15 carbon atoms with about seven moles of ethylene oxide and about four moles of propylene oxide.

* * * * *